US005449209A

United States Patent [19]

Breit

[11] Patent Number: 5,449,209

[45] Date of Patent: Sep. 12, 1995

[54] DOOR BLOCKING DEVICE

[75] Inventor: Roland Breit, Eden Prairie, Minn.

[73] Assignee: Intrusion Control Technologies, Inc., Edina, Minn.

[21] Appl. No.: 57,652

[22] Filed: May 6, 1993

[51] Int. Cl.[6] ..... B65D 45/30

[52] U.S. Cl. ..... 292/258; 292/339; 292/DIG. 15

[58] Field of Search ..... 292/258, 288, 343, DIG. 15, 292/DIG. 19, 339

[56] References Cited

U.S. PATENT DOCUMENTS

| | | | |
|---|---|---|---|
| 688,082 | 12/1901 | Geary | 292/DIG. 15 X |
| 842,691 | 1/1907 | Palmer | 292/DIG 15 X |
| 4,421,348 | 12/1983 | Kahn | 292/DIG. 15 X |
| 4,673,203 | 6/1987 | Chezen | 292/DIG. 15 X |
| 5,056,836 | 10/1991 | Wells | 292/DIG. 15 X |
| 5,135,273 | 8/1992 | MacCalder | 292/DIG. 15 X |

*Primary Examiner*—Philip C. Kannan
*Attorney, Agent, or Firm*—James R. Cwayna

[57] ABSTRACT

A portable and separable door blocking device functioning as a positive locking unit for a door to prevent its opening from the outside. The device includes an over-center locking unit with levers having members to block and lock a door by exerting forces in opposite directions. One lever includes a section positionable under a door and an upright section to abut with the side of the door. The second lever has at least one, reversible, downwardly and angularly disposed floor contacting member. When the unit is in locked, over-center position, the angularly disposed member prevents door movement and attempts to open the door will increase the holding force. The floor contacting member is adjustable to accomodate different floor-to-door gaps. A quick release is provided for emergency situations.

10 Claims, 2 Drawing Sheets

DOOR BLOCKING DEVICE

RELATED APPLICATIONS

There are no applications by applicant currently on file in the United States Patent Office related to this application.

FEDERAL SPONSORSHIP

This invention is not made under any Federally sponsored research or development arrangement nor under any other independently sponsored research and development arrangement.

FIELD OF THE INVENTION

This invention relates generally to a portable and separable locking or door blocking device useable upon any door and more specifically to a door blocking or locking device which includes an over-center locking arrangement with two active members exerting forces in opposite directions to each other a first of which is provided with a planar section which fits below the bottom of the door and a generally vertical section to abut with the side of the door. The second active member of the device provides, when the device is in blocking position, generally downwardly and rearwardly extending floor contacting element such that when the unit is positioned below the door and the operative levers are brought into their over-center position the vertical section abuts with the inside surface of the door, the planar member underlies the door and the floor contacting member is directed rearwardly, angularly downward to prevent the door from moving inwardly.

SHORT SUMMARY OF THE INVENTION

A door blocking or locking device completely separable from the door and which is adapted to doors of any width.

The unit basically includes an over-center or other locking type mechanism including a pair of levers and a quick release device. Each of the levers includes active portions with the first thereof providing a substantially planar section to slip below the door and a vertical section to fit against the inside surface of the door. The second lever includes an active member having a reversible floor contacting element which is adjustable with respect to this active member which will, upon closure of the operative levers of the unit be arranged angularly rearwardly and downwardly to contact the floor and prevent inward movement or opening of the door. The floor contacting member is reversible to provide a floor impinging end and a friction end, and is adjustable to accommodate the spacing that may exist between the existing floor and the bottom of the door.

The over-center action or other mechanical arrangement of the levers of the device positively locks the active portions in closed position and therefore the planar section and vertical section are locked against the bottom and side of the door and the floor contacting member is brought into either penetrating or frictional engagement with the floor.

BACKGROUND AND OBJECTS OF THE INVENTION

The primary aspect of protection against intrusion has long been a concern. This is particularly true of travelers that stay in motels or hotels as well as apartment dwellers and probably to a lesser extent, home dwellers. It is well known that a dead bolt will afford a higher degree of protection than an ordinary lock on a passage door but even a dead bolt does not insure against all intrusive situations.

There have been various devices as discussed in the Prior Art Statement which are directed to added security but they have not totally fulfilled the need and requirement for transportability, ease of application, positive locking, safety and prevention of intrusion. For example, several of the prior art units provide excessively large rods which have a means for attaching one end of the rod to the knob of a door with the other end angularly arranged to be positioned on the floor with the hope that this angular configuration will prevent pushing of the door inwardly. One of the major problems with such a device is that it is excessively long and is not easily carried by the user. Several other Prior Art devices include units which are used with the striker plate of the door frame and these devices fit between the door frame and the door edge. Obviously, if the door is tight within the frame, such devices are not useable in that no clearance for the unit is provided between the frame and door edge.

Applicant has provided a door blocking and effective locking device which eliminates the disadvantages of the prior art and provides a device which is easily operable, small enough to be easily transportable and which will provide a very positive door blocking and effective door locking unit which cannot be removed from its position from outside of the door. The device also provides a quick release facility for normal use as well as for use in case emergency exit through the door is required.

The applicant's device provides an over-center or other mechanical type lock mechanism wherein the active elements thereof are respectively provided with a planar section that slips under the door to abut with the bottom thereof and a vertically upright, blocking member which is brought into locking abutment with the side of the door when the levers are closed together and brought into the locked condition.

A quick release facility is provided for easy and unambiguous release from the locked over-center position which is of particular import in the event of an emergency.

The active member having the floor engaging member includes a reversible, angularly depending member with one end being rearwardly extending from the door and allowing penetration through carpet and pad, if present, and into the subfloor, with the other end providing a friction element to engage a floor without carpeting. Locking of the devices levers will bring this depending member into immovable floor contacting position while forcing the vertical section of the other active member against the side of the door.

Any force from the outside to move the door inwardly will be transferred to the floor contacting element to further enhance the locking and blocking capacity of the device.

To remove the unit it is simply necessary to actuate the locking release and pull the unit from below the door. The unit is of such a size that it can easily be carried in a purse or in a person's luggage.

It is therefore an object of the applicant's invention to provide a door block and lock device which includes an over-center or other type locking unit having a pair of active elements, one of which is provided with a planar section to be positioned below the door and engage the lower end thereof and also having a vertical section to engage the inside surface of the door with the other active element being provided with a rearwardly directed, downwardly depending floor penetrating member which is brought into engagement with the floor upon closure of the levers.

It is a further object of the applicant's invention to provide a door blocking and locking mechanism which includes an over-center lever or other type locking arrangement wherein active members of the unit are provided with a first under door plate or planar section and an upstanding, side-of-the-door contacting member such that when the over-center levers are closed the upstanding member is forced into contact with the side of the door and which automatically brings a floor engaging element into position to penetrate and impinge into the floor such that any force against the door to open the same will cause the floor impinging element to be more securely directed into the floor to increase holding power thereof.

It is a further object of the applicant's invention to provide a door blocking and locking mechanism which includes an over-center lever or other type locking arrangement wherein the active members of the unit are provided with a first under door plate or planar portion and an upstanding side-of-the-door contacting member such that when the over-center levers are closed the upstanding member is brought into contact with the side of the door and which automatically brings a floor, friction engaging element into position to frictionally engage the floor such that any force against the door to open the same will cause the friction element to more securely contact the floor to increase holding power of the device.

It is still a further object of the applicant's invention to provide a door blocking and locking device which includes an over-center, pivoted lever arrangement having a pair of active elements which extend forwardly from the pivot with one of such elements being provided with a plate or planar section to contact the lower edge of the door and a blocking section which is generally vertical for positive abutment with the side of the door when the levers are brought into over-center, locked position with the lower lever having an aperture therethrough to permit a floor contacting member to pass therethrough and be rearwardly and downwardly directed to contact the floor and wherein this floor contacting member is threadably adjustable to accommodate the spacing between the lower edge of the door and the floor over which it is installed.

These and other objects and advantages of the applicant's invention will more fully appear from a consideration of the accompanying drawings and description.

DESCRIPTION OF A PREFERRED FORM OF THE INVENTION

Figure 1:
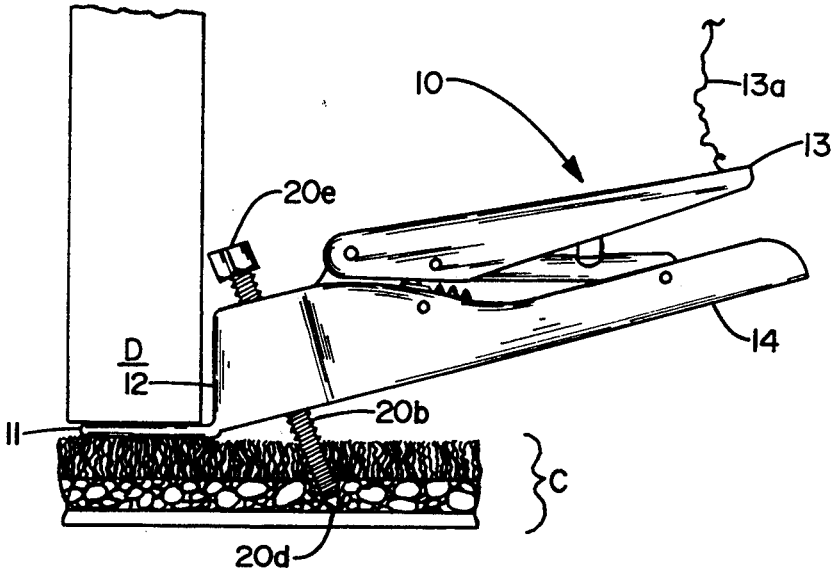
FIG. 1 is a side elevation of the door blocking and locking device as the same would be utilized in properly locking and blocking the door and illustrating the same when a carpet, pad and sub-floor are available.
Figure 2:
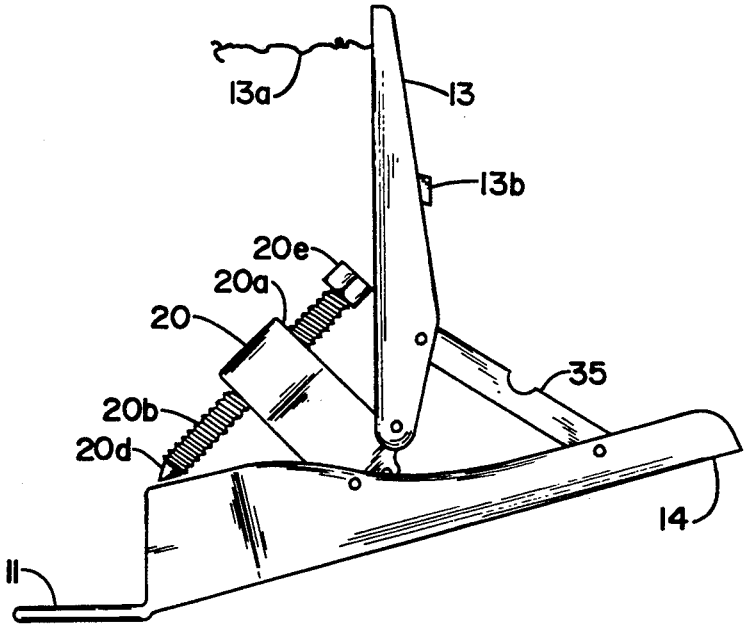
FIG. 2 is a side elevation of the door blocking and locking device in an open position.
Figure 3:
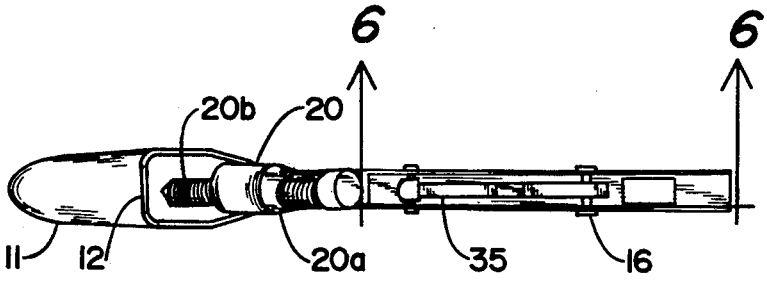
FIG. 3 is a top view of the device.
Figure 4:
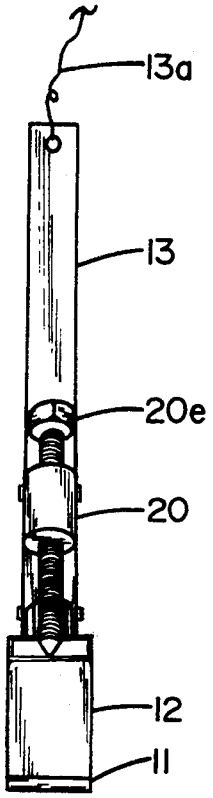
FIG. 4 is a front view of the device.
Figure 5:
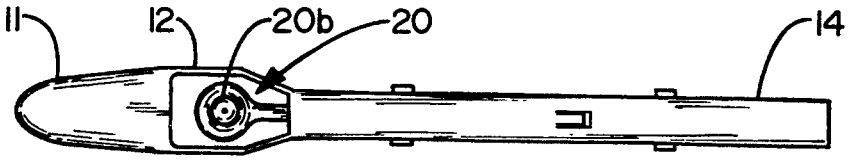
FIG. 5 is a bottom plan view of the device.

As illustrated in the accompanying drawings, the applicant's door locking and blocking device is generally designated 10 and is illustrated in FIG. 1 in positive locking arrangement against a door D wherein carpeting and pad generally designated C is provided. As illustrated in this view, the unit 10 is shown in locked position against the door having the planar, lower door engaging section 11 in abutment with the bottom surface of the door D and having a vertical abutment section 12 in close proximity to the door.

The primary aspects of the applicant's device are as disclosed wherein this locking element 10 is brought into and locked against the surfaces of the door through a pair of over-center levers 13, 14. A release element **13*a* is attached to the upper lever 13** to permit emergency release of the unit.

The over-center configuration includes the lower active lever 14 having the initial frontal portion 11 engageable with the bottom of the door with the vertical section 12 thereof having a formed lever member 20 threadably provided with a passage **20*a* therethrough to provide an adjustable passage for a threadable element 20*b* which, when brought into operative position will impinge or penetrate the floor surface as illustrated in FIG. 1**.

The lower lever of the device 14 is provided with a plurality of rotative assembly units 15, 16, 17, 18 to accommodate an over-center relationship between the primary levers 13, 14. A stop device **13*b* is provided to limit movement of the upper lever 13 by abutment against the bottom lever 14. As particularly illustrated in FIG. 6 a spring device 30 is provided on the lower active member 14 to aid in separateing the upper 13 and lower 14** levers when the locking engagement is released.

Figure 6:
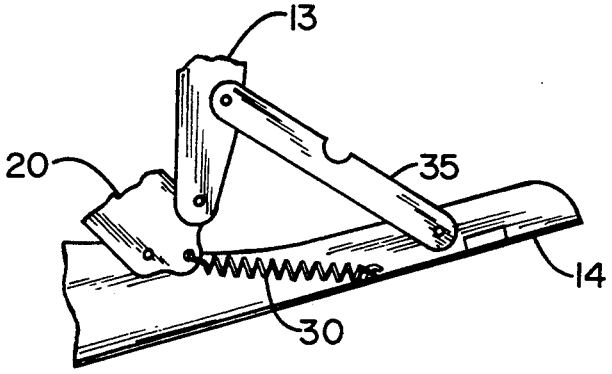
FIG. 6 is a vertical section taken substantially along Line 7—7 of FIG. 3.

An intermediate connective member 35, as best illustrated in FIG. 6 is provided to arrange for the rotative connective arrangements and over-center utilization of the two levers 13, 14.

As particularly illustrated, the lower lever 14 may be provided with an aperture **14*b* therethrough to allow the floor penetrating element 20*b*** to pass therethrough.

It should be obvious that a plurality of such floor engaging elements may be provided without departing from the scope of the invention.

As illustrated in the drawings, a quick release member **13*a* may be provided in conjunction with the upper lever 13 of the unit. Such an element may be attached to any portion of the door which is convenient to allow quick access to tripping of the over-center levers 13, 14**, or other utilized lever locking device.

The various pivotal connections between the lever units would be obvious to anyone skilled in the art and furthest disclosure of these devices is not deemed to be necessary for disclosure of the unit.

An operative aspect of the device is to provide a locking and door blocking unit that will abut with the inner and lower surface of a door to maintain the same in locked position.

As illustrated, a floor penetrating surface **20*b* is provided on the floor impinging unit. In order to provide a friction contact, the upper end 20*e* of such member can alternatively be provided with a friction surface such that when this unit is reversed, the friction engaging element 20*e*** will engage a floor surface that is not provided with a carpeting substrate or other similar material. This surface then will only frictionally engage the provided surface and will impede movement of a door inwardly.

It should be obvious that what the applicant has provided is a unique and relatively simple unit for positively locking and blocking of a door. It should be further obvious to any user that the position of such a unit would be remote from the hinge point of a door and would be at the outer end thereof.

What is claimed is:

1. A door blocking and locking device to prevent opening movement of the door when in position thereunder and thereagainst, said device including:

a. a pair of pivotally mounted arms, each of said arms having a rearwardly directed, operative, hand grasping lever end and a forwardly directed, operative active end, said ends being arranged on opposite sides of a pivotal mount of said arms;

b. a first of said active ends being provided with a forwardly extending, substantially planar section for sliding below the lower edge of a door and a vertically extending section for positioning against the inside surface of the door;

c. the second of said active ends being provided with at least one downwardly, angularly directed floor contacting means, said second active end arranged for movement with respect to said first active end to bring said floor contacting means into position to contact a floor surface when said first active end is brought into door contacting position, the angle of said contacting means being downwardly and rearwardly from the door such that an opening force applied to the door will increase resistance to movement of the door; and d. said arms being pivotally mounted with respect to one another and including linkage therebetween to provide a mechanical type locking mechanism which holds the active elements of said arms in door and floor contacting, locked position when closed.

2. The door blocking and locking device as set forth in claim 1 and said locking mechanism consisting of an over-center lever arrangement.

3. The door blocking and locking device as set forth in claim 1 and said locking mechanism consisting of a movable mechanical link attached to one of the levers and engagable with the other to hold them in locking arrangement with each other.

4. The door blocking and locking device as set forth in claim 1 and said floor contacting means including a floor penetrating means on one end thereof.

5. The door blocking and locking device as set forth in claim 1 and said floor contacting means including friction means to provide friction engagement with the floor.

6. The door blocking device as set forth in claim 1 and said floor contacting means including a dual ended element wherein one end is provided with floor penetrating means and the other end is provided with a friction, floor contacting means.

7. The door blocking and locking device as set forth in claim 1 and:

a. said second active end being provided with a threaded passage therethrough: and, b. said floor contacting member including a threaded rod member receivable into and adjustable within said threaded passage of said second active end.

8. The door blocking and locking device as set forth in claim 7 and:

a. said floor contacting member including a floor penetrating end and a floor friction end, said threaded rod being reversibly positionable into said threaded passage of said second active end.

9. The door blocking and locking device as set forth in claim 1 and said lever ends being arranged and constructed to achieve a locked position wherein said first active end is brought into contact with the bottom and side of the door and said floor contacting means is brought into holding contact with the floor, the two active ends exerting forces in directions opposite to each other, said levers also providing an open position for removal of the device from the door and floor.

10. The door blocking and locking device as set forth in claim 9 and an attached cord arrangement on one of said lever ends for quick and unambiguous release of said lever ends from the closed and locked position to the open position.

* * * * *